US006634534B2

(12) United States Patent
Frodl et al.

(10) Patent No.: US 6,634,534 B2
(45) Date of Patent: Oct. 21, 2003

(54) PAPER WEB GUIDANCE DEVICE

(75) Inventors: Herbert Frodl, Poing (DE); Axel Herbst, Munich (DE)

(73) Assignee: Océ Printing Systems GmbH, Poing (DE)

( * ) Notice: Subject to any disclaimer, the term of this patent is extended or adjusted under 35 U.S.C. 154(b) by 0 days.

(21) Appl. No.: 10/045,394

(22) Filed: Nov. 9, 2001

(65) Prior Publication Data

US 2002/0179671 A1 Dec. 5, 2002

(51) Int. Cl.[7] ..... B65H 20/00
(52) U.S. Cl. ..... 226/183; 242/615.3
(58) Field of Search ..... 226/17, 196.1, 226/183; 242/615.3

(56) References Cited

U.S. PATENT DOCUMENTS

| | | | | | |
|---|---|---|---|---|---|
| 1,315,750 | A | * | 9/1919 | Swenson | 226/17 X |
| 2,635,873 | A | * | 4/1953 | Worm | 226/17 |
| 2,718,156 | A | * | 9/1955 | Wright | 226/17 X |
| 2,737,386 | A | * | 3/1956 | Reher | 226/17 |
| 3,915,449 | A | * | 10/1975 | Johnson et al. | 226/196.1 X |
| 4,909,425 | A | * | 3/1990 | Susini et al. | 226/17 |
| 5,213,246 | A | * | 5/1993 | Crowley | 226/196.1 X |
| 5,685,471 | A | | 11/1997 | Taubenberger | |
| 5,791,794 | A | | 8/1998 | Kopp et al. | |
| 6,354,478 | B1 | * | 3/2002 | Bruckel | 242/615.3 X |

FOREIGN PATENT DOCUMENTS

| | | |
|---|---|---|
| WO | WO 95/19929 | 7/1995 |
| WO | WO 96/03282 | 2/1996 |
| WO | WO 99/24875 | 5/1999 |

* cited by examiner

*Primary Examiner*—Kathy Matecki
*Assistant Examiner*—Evan Langdon
(74) *Attorney, Agent, or Firm*—Schiff Hardin & Waite

(57) ABSTRACT

In a web guidance device, particularly for a continuous form printer device, deflection seat is provided around which a recording medium web is guided in a conveying direction. A lateral guide roller influences the recording medium web with a laterally acting force in a region of a deflection seat such that the recording medium web lies against the lateral detent. A planarly acting hold-down element is provided in a region of a lateral guide roller, the hold-down element pressing the recording medium web onto the deflection seat with a specific pressing power.

10 Claims, 4 Drawing Sheets

PAPER WEB GUIDANCE DEVICE

BACKGROUND OF THE INVENTION

The present invention is directed to a web guidance device and to a method for guiding a moving recording medium web for a printing system, and particularly, a web guidance device for a continuous form printer device.

In the present application, a recording medium web and particularly a recording medium that has a slight to extremely slight thickness compared to a planar extent of the recording region is provided. Of course, the present invention also covers recording media that are not or not completely comprised of paper but, for example, comprise a plastic part, are completely of plastic, or have some other composition. Moreover, a recording medium provided as a roll material both with or without a margin perforation can be transported with the apparatus or the method of the present invention.

WO 99/24875 A1 (corresponding to U.S. Ser. No. 555,415) and WO 95/19929 A1 (corresponding to U.S. Pat. No. 5,685,471) disclose paper web guidance devices. These two publications are incorporated by reference into the present specification.

FIG. 2*a* of WO 99/24875 A1 shows a stop plate 9 of a pre-centering device 8. This stop plate 9 is secured to a runner and can therefore be displaced. The displacement occurs along a corrugated profile plate, what is referred to as a deflection seat. The guidance for an edge of the transported paper can be adjusted with the displacement of the stop plate 9. The stop plate lends the paper or, respectively, a paper web, its lateral guidance.

WO 95/19929 A1 discloses a braking device that applies a stabilization onto the paper web, so that this is no longer intended to deviate from the laterally stable position before it reaches a transfer printing region lying at a distance.

In the aforementioned Prior Art, thus the stop plate is the determining guide element for the paper web. What has now turned out to be a disadvantage of this Prior Art is that lateral damage to the paper occurs, especially given thin paper webs. Although the paper web is guided at the lateral guide plate, the mechanical stability of a lightweight, thin paper is slight, so that the forces that are introduced into the paper and occur at the edge of the paper web at the stop plate can become too high and lead to a bending or beading of the paper.

This disadvantage can be so influential that a proper paper running is no longer assured in the printer device.

SUMMARY OF THE INVENTION

It is therefore an object of the present invention to create a paper web guidance device for guiding a moving paper web such that damage to the paper web in the lateral region is dependably prevented.

According to the present invention, a web guidance device and method is provided for a continuous form printer device. The web guidance device has a deflection seat around which a recording medium web, particularly a paper web, is guided in a conveying direction. A lateral guide roller influences the recording medium web with a laterally acting force in a region of a deflection seat such that the recording medium web lies against a lateral detent. A planarly acting hold-down element is provided in a region of a lateral guide roller, the hold-down element pressing the recording medium web onto the deflection seat with a specific pressing power.

The paper web guidance device that is used in what is referred to as fan-fold printer devices that print onto a web-shaped recording medium, and comprises a deflection seat around which the web-shaped recording medium, particularly a paper web, is guided in the conveying direction. It further comprises a lateral guide roller that influences the paper web with a laterally acting force in the region of the deflection seat such that the paper web lies against a lateral detent. A planarly acting hold-down element that presses the paper web onto the deflection seat with a specific pressing power is provided in the region of the lateral guide roller.

A method for guiding a moving paper web that is adapted to the invention comprises the following steps: conveying the paper web via a deflection seat; influencing the paper web with a force in the region of the deflection seat, the force acting transversely relative to the conveying direction and being applied with a lateral guide roller that influences the paper web such that the paper web lies against a lateral detent, whereby the paper web is pressed onto the deflection seat with a specific pressing power in the region of the lateral guide roller, and whereby a planarly acting hold-down element generates the pressing power.

What can be advantageously achieved with the invention is that, even given especially thin paper webs, a buckling or beading at the lateral detent can be dependably prevented by the hold-down force that the hold-down element exerts onto the paper web in the region of the lateral guide.

As a result of being held down, the paper is prevented from escaping upward. The force that acts laterally between the lateral guide and the paper edge can be introduced into the paper without the edge beading and/or being damaged at the lateral detent.

The simple principle of the web edge control can therefore be employed despite extremely lightweight and thin papers. An escape onto, for example, the offset region with an involved web edge control via rotating frames is no longer required.

The above object, the features and advantages of the present invention can be understood better taking the following, detailed description of the preferred embodiments of the present invention into consideration and with reference to the corresponding figures.

DESCRIPTION OF THE PREFERRED EMBODIMENTS

Figure 1:
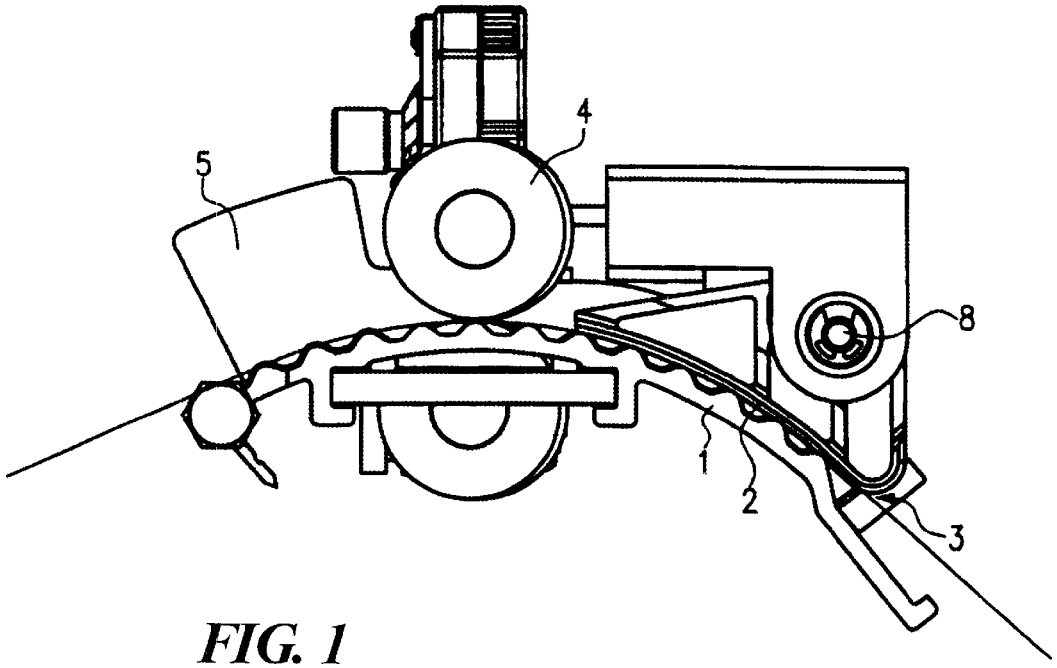
FIG. 1 is a side view of the inventive paper web guidance device.

For the purposes of promoting an understanding of the principles of the invention, reference will now be made to the preferred embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

A paper web 3 is guided via a deflection seat 1 that is implemented as a corrugated or rifled plate, whereby the paper web is influenced with a force by means of a lateral guide roller 4 such that the paper web 3 is pressed or loaded in the direction of a lateral detent 5. A hold-down element 2 is provided in the region of the lateral guidance roller 4—preceding the lateral guidance roller 4 in the illustrated embodiment—, the hold-down element 2 influencing the paper web 3 with a pressing power such that the paper web is pressed down onto the deflection seat 1.

As a result thereof, the paper web 3 can absorb the lateral guide forces to a greater extent compared to an embodiment without the hold-down element 2.

The hold-down element 2 is preferably designed with a large-area, i.e. the hold-down element 2 extends over a width of approximately 2–3 cm and a length of approximately 5–6 cm given exemplary dimensions.

The hold-down element 2 is preferably arranged preceding the lateral guide roller, but, in particular, also extends to such an extent that there is an overlap with the length of extension of the lateral detent 5.

The hold-down element 2 is pressed down by means of an elastic element 6, preferably a spring, whereby the pressing power can be adjusted via the elastic element 6 or the lever action at a suspension of the hold-down element 2.

The hold-down element 2, finally, is advantageously adapted in curvature to the arch of the deflection seat 1, so that an optimally constant gap is formed between the hold-down element 2 and deflection seat 1. The paper web 3 proceeds through the gap.

The following steps are implemented for guiding a moving paper web 3, particularly in a continuous form printer device: conveying the paper web 3 via a deflection seat 1; influencing the paper web 3 with a force in the region of the deflection seat 1, the force acting transversely relative to the conveying direction and being applied with a lateral guide roller 4 that influences the paper web 3 such that the paper web 3 lies against a lateral detent 5, whereby the paper web 3 is pressed onto the deflection seat 1 with a specific pressing power in the region of the lateral guide roller 4, and whereby a planarly acting hold-down element 2 generates this pressing power.

In this method, the pressing power is preferably applied onto the paper web 3 preceding the lateral guide roller 4, whereby the pressing power exerted with the hold-down element 2 acts over a length that at least partly overlaps with the region of the extent of the lateral detent 5.

It is thereby especially advantageous when the hold-down element 2 is held at a bracket 10 that is in turn held rotatable around a swivelling axis 9. A ball bearing 8 that assures the correct axial guidance of the hold-down element 2 on the deflection seat 1 is provided between the bracket 10 and the actual hold-down element 2.

The ball bearing 8 is implemented as a ball-and-socket joint and allows an excursion of the hold-down element 2 such that an optimum alignment, i.e. an alignment free of angular errors, can automatically occur relative to the deflection seat 1.

Figure 2:
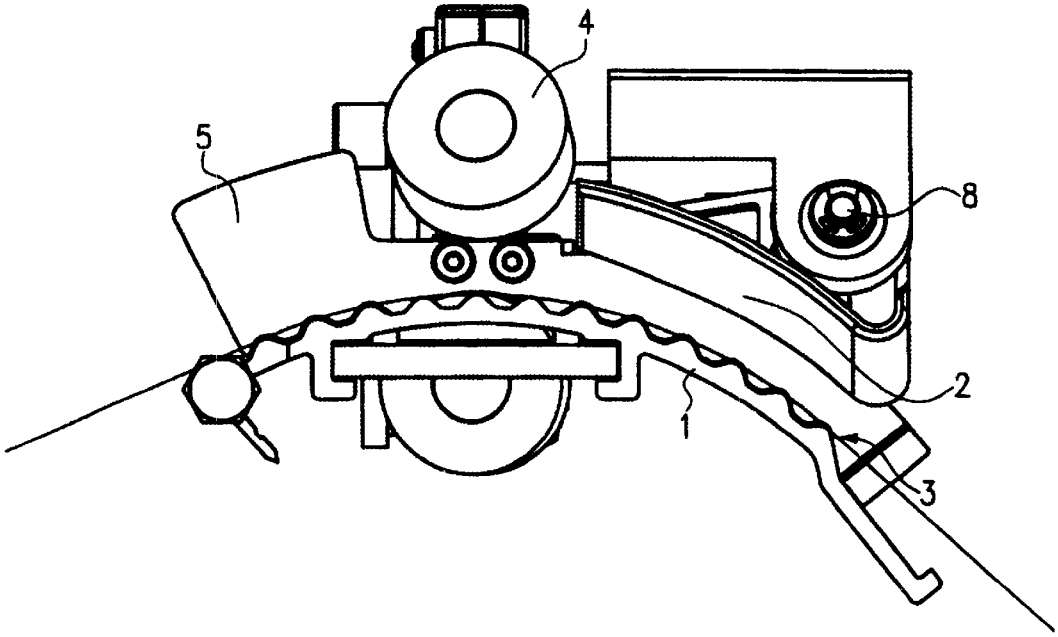
FIG. 2 is a further side view of the paper web guidance device of FIG. 1.

In FIG. 1, the hold-down element 2 is shown in a position in which the paper web 3 is inserted, whereas the hold-down element 2 is pivoted up around the swivelling axis 9 in FIG. 2, so that the paper web 3 can be inserted.

Figure 3:
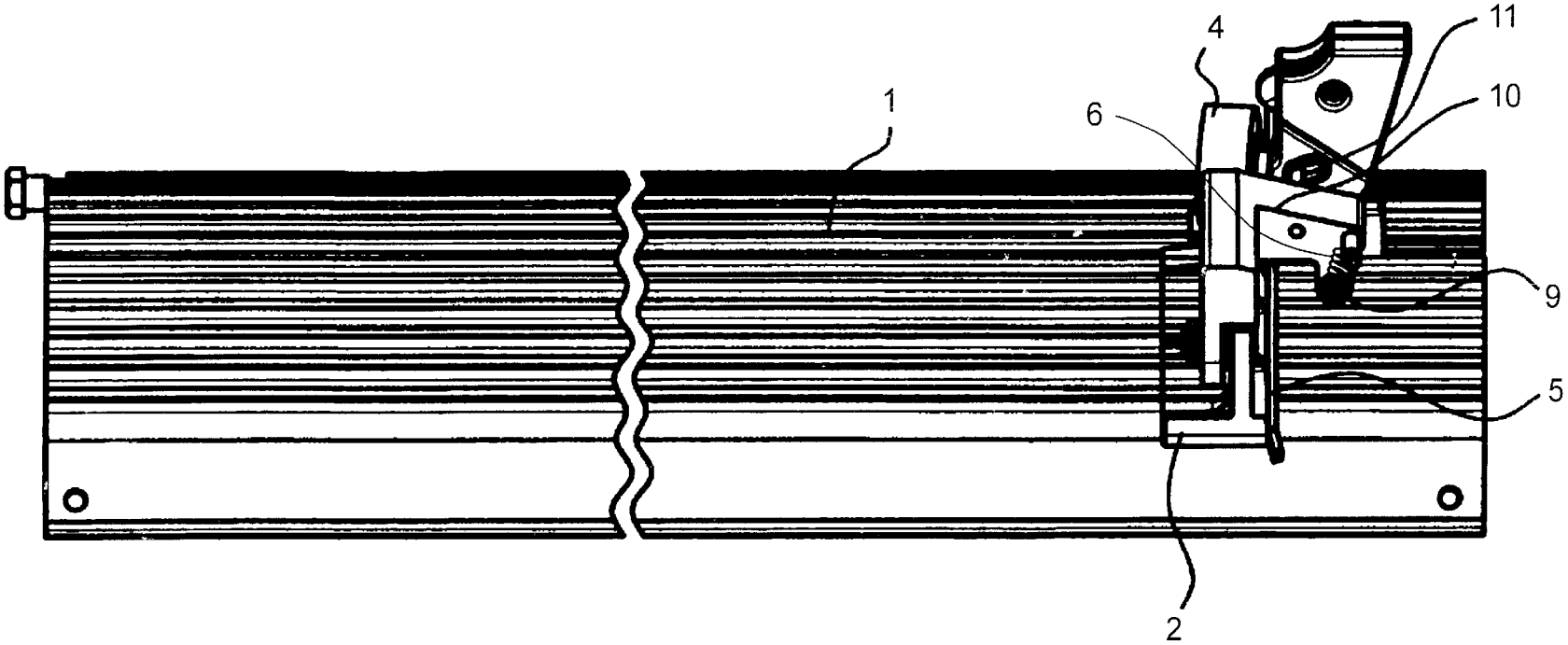
FIG. 3 is a view of the paper web guidance device in the transport direction of the paper web.

Finally, FIG. 3 also shows a guide channel 11 that guides the bracket 10 around the swivelling axis 9 in a specific angular range with a guide pin and allows no farther-reaching excursion.

The elastic element 6 is preferably implemented as a coil spring and presses the hold-down element 2 onto the paper web 3 or, respectively, the deflection seat 1 with a specific force.

Summarized again, the recording medium web guidance device that, in particular, is provided for a continuous form printer device, comprises a deflection seat 1 around which a paper web 3 is guided in the conveying direction, and comprises a lateral guide roller 4 that influences the paper web 3 with a laterally acting force in the region of the deflection seat 1 such that the paper web lies against a lateral detent 5, whereby a planarly acting hold-down element 2 is provided in the region of the lateral guide roller 4 and presses the paper web 3 onto the deflection seat 1 with a specific pressing power. The inventive method for guiding the moving paper web comprises the steps: Conveying the paper web 3 via a deflection seat 1; charging the paper web 3 with a force in the region of the deflection seat 1, said force acting transversely relative to the conveying direction and being applied with a lateral guide roller 4 that charges the paper web 3 such that the paper web 3 lies against a lateral detent 5, whereby the paper web 3 is pressed onto the deflection seat 1 with a specific pressing power in the region of the lateral guide roller 4, and whereby a planarly acting hold-down element 2 generates the pressing power.

Figure 4:
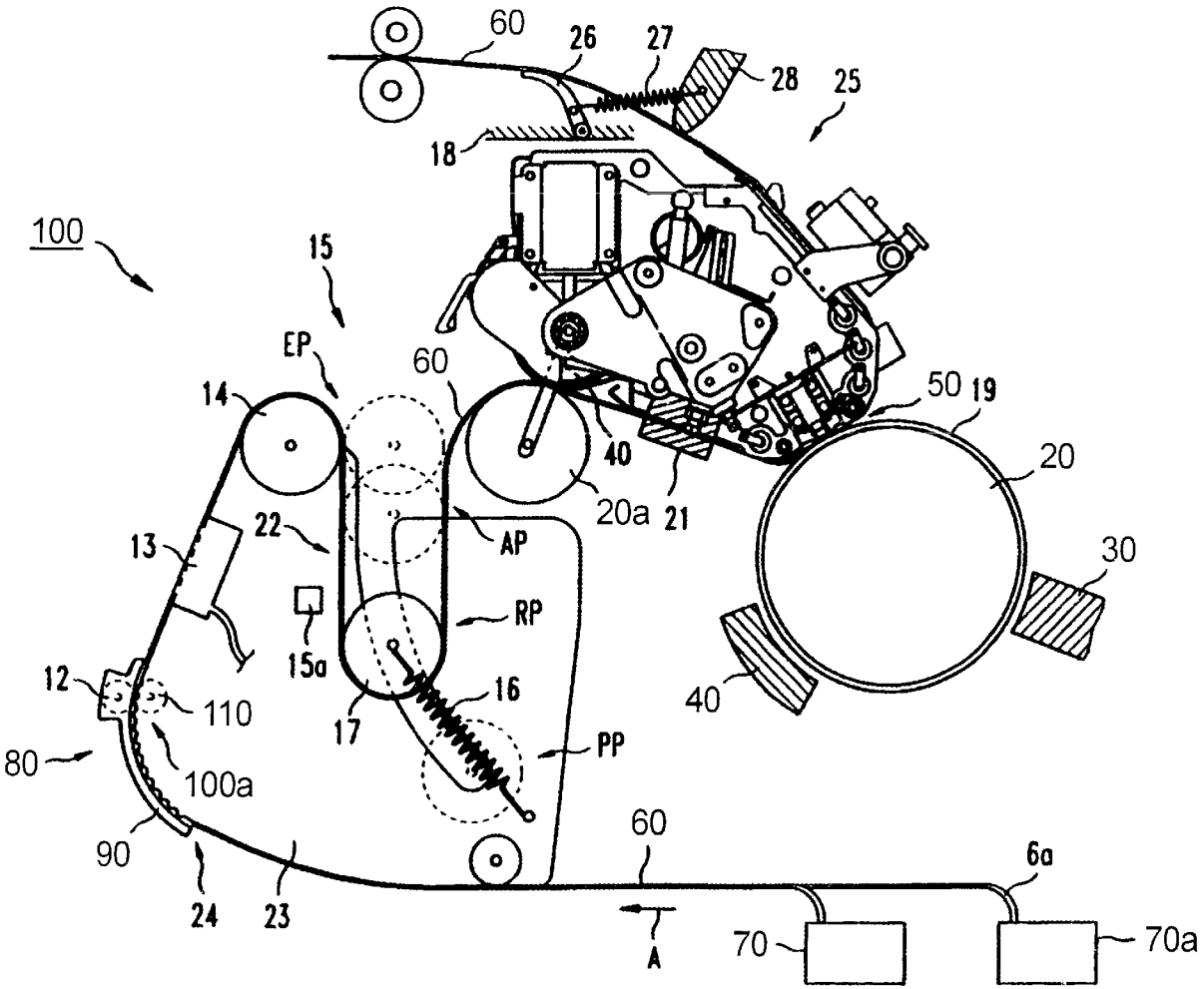
FIG. 4 shows the running of the paper within an electrophotographic printer.

The paper transport device 100 shown in FIG. 4 conveys a paper web 60 from a paper supply 70 via a pre-centering device 80 and a drive unit 25 to a transfer printing station 50. At the latter, the paper 60 accepts toner from the surface 19 of a photoconductor drum 20, this toner having been applied onto the photoconductor drum 20 in the developer station 40. The information that is thereby transferred corresponds to the latent image information written on the photoconductor drum 20 with a character generator 30 containing a light-emitting diode comb (LED).

Overall, the paper transport largely corresponds to the arrangement disclosed by WO 95/19929 A1. The content thereof is hereby incorporated by reference into the present specification.

In the pre-centering device 80, the paper web 60 is deflected by approximately 90° in the region of a stop plate 90. This region forms a deflection path 24. The paper web 60 is thereby passed through between a roller arrangement 100*a*, whereby both the bottom rollers 110 as well as the top rollers 12 are placed obliquely relative to the paper transport direction A, so that the rotary motion of the rollers 110, 12 exerts a force perpendicular to the transport direction A onto the paper web 60. As a result thereof, the paper web 60 is pressed against the stop plate 90, which assures an adequately exact guidance. The top rollers 12, in particular, are seated pivotable at the common profile carrier 23, so that a new paper web can be easily inserted between the rollers 110, 12.

After the pre-centering in the deflection path 24, the paper web 60 passes through a paper brake 13. The braking effect thereof is based on an under-pressure with which the paper web 60 is drawn against an under-pressure chamber and, thus, decelerated. A tension is generated in the paper web 60 as a result of this braking.

Subsequently, a deflection roller 14 supplies the paper web 60 to a first loop-forming element 15. The loop-forming element 15 is essentially comprised of a movably seated roller 17 that is pulled opposite the paper tension by a spring 16. As a result thereof, a paper supply loop 22 arises. The paper web 60 wraps the roller 17 by approximately 180 degrees, as a result whereof it is stabilized perpendicular to the transport direction A. The roller 17 is implemented in light-gauge fashion. Its core, however, is comprised of rigid material, for example of carbon fiber-reinforced plastic (CFK), in order to minimize elastic spring effects within the roller 17. The loop-forming element 15 and the under-pressure brake 13 form a regulating system that generates a constant tension of the paper web 60 from the under-pressure brake 13 to a point beyond the transfer printing station 50. Magnetoresistive sensors 15*a* thereby sense the position of the roller 17. During printing operations, the roller 17 is held as constant as possible in a working position AP. The spring 16 has an exactly defined working range in a narrow region. With eight measuring points, the sensors 15*a* have high resolution in the region around the working point AP. The under-pressure in the brake 13 is then set such that the roller position deviates as little as possible from a rated position.

The roller 17 is in an upper insertion position EP for inserting a new paper web 60. During a print stop (for example, when the drive unit 25 is pivoted away from the photoconductor drum), the roller 17 is in the retreat position RP, whereby the loop 22 is larger than in the work position AP. If the paper web 60 rips, then the roller 17 moves into the lower position PP. One of the sensors 15*a* detects this event and outputs a corresponding error message to the system controller.

Following the loop-forming element 15, the paper web 60 is supplied to the drive unit 25. Pressure rollers 20*a* press the paper web 60 against a drive drum 40 of the input side that drives the paper web 60 in the direction to the transfer printing station 50. Before the paper web 60 reaches the transfer printing station 50, it is optoelectronically sensed with a paper width sensor 21.

After the paper web 60 has passed through the transfer printing station 50, the drive unit 25 supplies it to a second loop-forming element 26 that acts by the tension of a spring 27 that is seated at a housing projection 28 of the printer housing 18. After passing the second loop-forming means 26, that paper web 60 can be supplied to further units, for example to a known fixing device wherein the toner image is fixed on the paper web 60.

The exemplary embodiment that has just been described assumes that only one paper web 60 is transported through the transfer printing station 50. In a second exemplary embodiment, it can just as easily be provided that two paper webs 60, 6*a* lying side-by-side are simultaneously transported through the transfer printing station 50. The second paper web would thereby be taken from a second paper supply 7*a*. All paper guidance and paper transport elements as well as the transfer printing station and the photoconductor drum 20 would be adapted in view of the geometrical dimensions such that the two paper webs 60, 6*a* can pass through the transfer printing station 50 next to one another. The arrangement of the paper web and of the transport devices can thereby occur as in WO 96/03282 A1 (corresponding to U. S. Pat. No. 5,791,794).

The paper transport direction is uniformly referenced A in the Figure descriptions that now follow. The other reference characters have also been retained insofar as the same or structurally identical elements are involved in the following Figure descriptions.

Figure 5A:
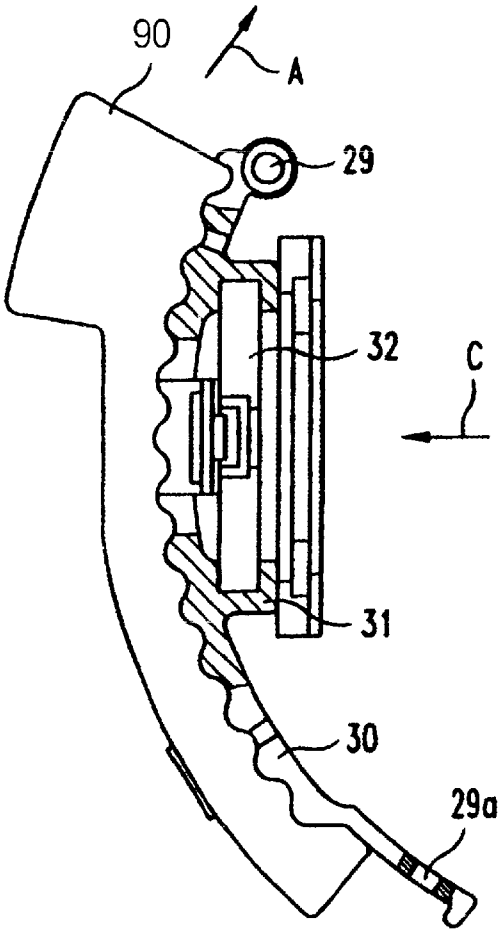
FIGS. 5A–5B illustrates guide elements for the paper guidance.

The stop plate 90 of the pre-centering device 80 is shown in greater detail in FIG. 5*a*. It is seated firmly on a runner 32 that is seated displaceable along a corrugated profile plate 30. For this purpose, the corrugated profile plate 30 is equipped with guide profiles in the region of the runner 32, so that the runner 32 is displaceable perpendicular to the character direction. The guide plate 90 also displaces together with the displacement of the runner 32. The corrugated profile 30 is to be secured to the profile carrier 23 of the pre-centering device 80, being secured thereto with a suspension 29 as well as by means of screw openings 29*a*. In the overall paper running (FIG. 1), the guide plate 90 prescribes the lateral guidance of the paper web 60. As disclosed in WO 95/19929 A1, braking device and loops effect such a high stabilization of the paper web 60 that it no longer deviates from this laterally stable position before reaching the transfer printing region 5. Within the overall paper transport arrangement, thus the guide plate 90 is the crucial lateral guide element for the paper web 60.

Figure 5B:
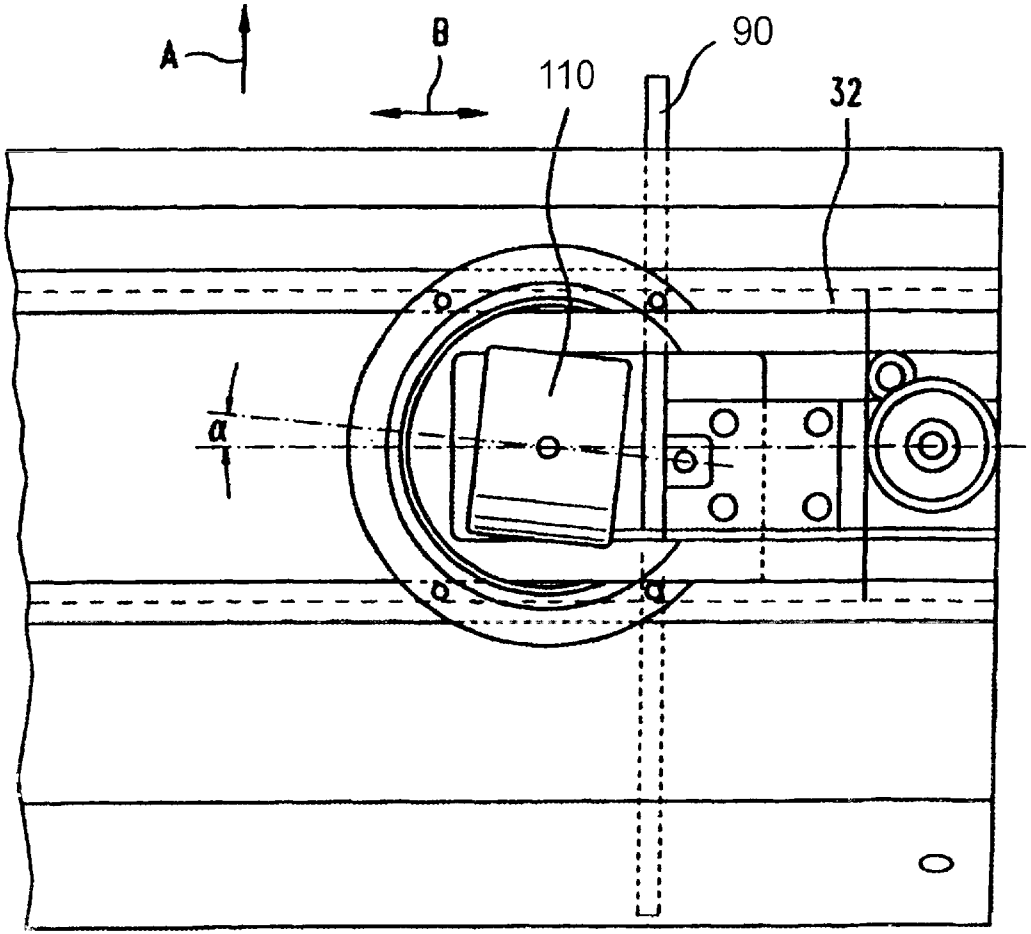

Both roll material with lateral margin perforation as well as roll material without lateral margin perforation can be transported with the described paper transport because the transport occurs only by means of friction. What is of concern in the region of the transfer printing station 50 is that the printable region of the paper comes to lie in a specific region of the photoconductor drum dependent on the type of paper inserted (with/without margin perforation). Accordingly, it can be necessary to adapt the lateral guide plate 90 to the type of paper, i.e. to modify the position of the guide plate 90 perpendicular to the paper transport direction A. This can occur by displacement of the guide plate 90 with the runner 32 within the guide recess 31 along direction B. FIG. 5B shows the view C of FIG. 5A. The stop plate 90 is thereby displaceable along direction B together with the runner 32. The lower ball bearing roller 110 is thereby co-displaced, so that the relative position between ball bearing roller 110 and stop plate 90 is preserved.

The ball bearing roller 110 is inclined at an acute angle $\alpha$ of about 6° relative to the direction B. What this effects is that paper that moves in transport direction A is lent a friction force toward the stop plate 90 transverse to the transport direction A (in direction B). As a result thereof, the paper web 60 is automatically guided along the stop plate 90.

Further details and effects of the paper web transport device shown in FIGS. 4, 5*a* and 5*b* can be derived from WO 99/24875 A1 that was already cited at the outset and whose content is again expressly incorporated by reference at this.

The apparatus can be employed not only within printer devices for web-shaped recording media but can also be employed in printing systems wherein printer devices are connected to preceding and following processing devices for the recording medium web such as, for example, to unrolling devices, to wind-up devices, web cutter devices, etc. The invention can be applied both in web guidance units or web transport units that lie between these devices as well as within such pre-processing or post-processing devices.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

We claim as our invention:

1. A guidance device for a continuous form printer device, comprising:

a deflection element across which a recording medium paper web is guided in a conveying direction;

a lateral guide roller that influences the recording medium web with a laterally acting force in a region of the deflection element such that the recording medium lies against a lateral detent; and a hold-down element arranged preceding the lateral guide roller in the conveying direction in a region of the lateral guide roller, said hold-down element pressing the recording medium onto the deflection element with a specific pressing power.

2. The web guidance device according to claim 1 wherein the deflection element has a curvature and the hold-down element has a curvature substantially meshed to the curvature of the deflection element.

3. The web guidance device according to claim 1 wherein the hold-down element acts on the recording medium web over a length in the conveying direction which is a substantial portion of a length of extent of the lateral detent in the conveying direction.

4. The web guidance device according to claim 1 wherein the deflection element is a rifle plate.

5. The web guidance device according to claim 1 wherein the hold-down element is pressed onto the recording medium web by at least one elastic element.

6. The web guidance device according to claim 5 wherein the elastic element comprises a spring.

7. The web guidance device according to claim 1 wherein the hold-down element is hinged to a bracket with a ball-and-socket joint.

8. A web guidance device for a continuous form printer device, comprising:

a curved deflection seat around which a recording medium paper web is guided in the conveying direction;

a lateral guide roller that influences the recording medium web with a laterally acting force in a region of the deflection seat such that the recording medium web lies against a lateral detent; and a hold-down element in a region of the lateral guide roller having a curvature substantially matched to a curvature of a deflection seat, said hold-down element pressing the recording medium web onto the deflection seat.

9. A method for guiding a web in a printer device, comprising the steps of:

guiding a recording medium web along a deflection element in a conveying direction;

with a lateral guide roller, applying a laterally acting force in a region of the deflection element such that the recording medium lies against a lateral detent; and with a hold-down element provided in a region of the lateral guide roller and preceding the lateral guide roller in a conveying direction, pressing the recording medium web onto the deflection element.

10. A method for guiding a web in a printer device, comprising the steps of:

guiding a recording medium web around a curved deflection seat in a conveying direction;

with a lateral guide roller, applying a laterally acting force in a region of the deflection seat such that an edge of the recording medium abuts against a lateral detent; and with a hold-down element provided in a region of the lateral guide roller and having a curvature matched to a curvature of the deflection seat, pressing the recording medium web onto the deflection seat with a specific pressing power.

* * * * *

UNITED STATES PATENT AND TRADEMARK OFFICE

CERTIFICATE OF CORRECTION

PATENT NO. : 6,634,534 B2
DATED : October 21, 2003
INVENTOR(S) : Herbert Frodl and Axel Herbst It is certified that error appears in the above-identified patent and that said Letters Patent is hereby corrected as shown below:

Title page,
Insert Item -- [30], Foreign Application Priority Data
June 1, 2001 (DE) .-……...201 09 201.8 --

Signed and Sealed this

Nineteenth Day of October, 2004

JON W. DUDAS
*Director of the United States Patent and Trademark Office*